US007507074B2

(12) United States Patent
Munshi et al.

(10) Patent No.: US 7,507,074 B2
(45) Date of Patent: Mar. 24, 2009

(54) FAN MOUNTING SYSTEM

(75) Inventors: Mahamad Rafik Munshi, Cordova, TN (US); William B. Graham, Hamilton, NY (US)

(73) Assignee: Hunter Fan Company, Memphis, TN (US)

( * ) Notice: Subject to any disclaimer, the term of this patent is extended or adjusted under 35 U.S.C. 154(b) by 159 days.

(21) Appl. No.: 11/350,592

(22) Filed: Feb. 9, 2006

(65) Prior Publication Data

US 2007/0183899 A1 Aug. 9, 2007

(51) Int. Cl.
*F03D 11/04* (2006.01)
*F04D 29/60* (2006.01)

(52) U.S. Cl. ..... 416/246; 415/213.1; 248/343

(58) Field of Classification Search ..... 416/63, 416/246, 248; 415/213.1; 248/170, 343, 248/344, 436, 440

See application file for complete search history.

(56) References Cited

U.S. PATENT DOCUMENTS 2,123,448 A * 7/1938 Weber ..... 416/246
2,215,035 A * 9/1940 Gundelfinger ..... 416/246
2,857,095 A 10/1958 Suarez Grau
4,457,672 A * 7/1984 Ogura et al. ..... 417/360
4,515,538 A * 5/1985 Shih ..... 417/572
D414,256 S 9/1999 Thomas, Jr.
6,682,308 B1 * 1/2004 Fei et al. ..... 416/246

* cited by examiner

*Primary Examiner*—Edward Look
*Assistant Examiner*—Nathaniel Wiehe
(74) *Attorney, Agent, or Firm*—Baker Donelson

(57) ABSTRACT

A fan (10) is disclosed having a base (11) and a protective housing (12) encasing an electric motor (13) and a blade assembly (14). The base has two pivot mounts (21) to which a front support leg (22) and a rear support leg (23) are mounted. Each leg includes a mounting flange (24). The pivot mounts allow the pivotal movement of the protective housing relative to the pivot mounts and about horizontal axis AA. The base also includes a ceiling mount portion (28) which is mounted to the ceiling C. The ceiling mount portion includes a mounting plate (32), a rod (33), and a cup-shaped coupler (34). The coupler has an annular groove (35) therein adapted to receive the mounting flanges. The coupler is configured to allow the flanges to be rotated while nested within the groove, thereby allowing pivotal movement of the fan about the rod and about vertical axis AB.

10 Claims, 2 Drawing Sheets

FAN MOUNTING SYSTEM

TECHNICAL FIELD

This invention relates to fans, and specifically to a mounting system for a fan.

BACKGROUND OF THE INVENTION

Electrically powered, portable fans typically have a motor mounted to a base that is positioned upon a table or a floor. In operation, the motor rotates an annular array of blades. These blades are typically encased within a protective safety grill to prevent direct access to the rotating blades.

With many fans, the base is in the form of a single pedestal, as shown in U.S. Pat. No. D414,256. Alternatively, the fan may include two U-shaped legs which support the motor and blades, as shown in U.S. Pat. No. 2,857,095. Additionally, the fan shown in U.S. Pat. No. 2,857,095 may be mounted to a window sill rather than being positioned upon the ground. This mounting of the fan allows it to be pivoted along a first vertical axis of rotation associated with the mounting of the fan to the sill, as shown in FIG. 6, and a second vertical axis of rotation associated with the pivotal joints 18, as shown in FIG. 5. This mounting system however still limits the positioning of the fan through these two parallel axes of rotation, for when the fan was mounted to the side of a sill it can only be rotated horizontally to direct air along different sides of room. Similarly, when mounted to the top of a sill it can only be rotated vertically to direct air along different heights within the room. As such, the fan can not be adjusted to direct air to all areas with a given room when it is mounted to a window sill.

Accordingly, it is seen that a need remains for a fan capable of having a greater degree of positions relative to a mounting surface. It is to the provision of such therefore that the present invention is primarily directed.

SUMMARY OF THE INVENTION

In a preferred form of the invention a fan comprises a motor, an annular array of blades mounted to the motor, a protective housing surrounding the annular array of blades, a leg assembly having at least one leg coupled to the protective housing, the leg having a mounting flange, and a mount including a coupler adapted to receive the mounting flange.

DETAILED DESCRIPTION

Figure 1:
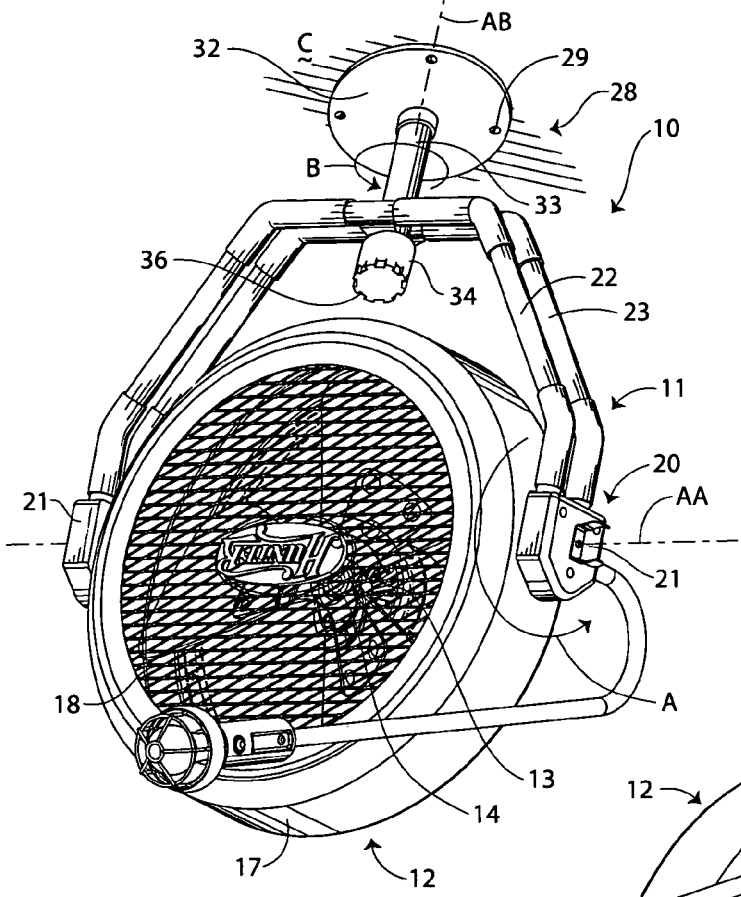
FIG. 1 is a perspective view of a fan mounting system that embodies principles of the invention in its preferred form, shown in a position mounted to a ceiling.

With reference next to the drawings, there is shown a fan 10 having a base 11 and a protective housing 12 encasing an electric motor 13 and a blade assembly 14 having an annular array of blades coupled to the motor 13. The protective housing 12 includes an annular shroud 17, a front grill 18 and a rear grill. The electric motor 13 is connected to a source of electric power by unshown wires that extend from the electric motor 13. The electric motor rotatably drives the blade assembly 14 to produce an airflow.

The base 11 includes a supporting leg assembly 20 which has two oppositely disposed pivot mounts 21 coupled to the shroud 17 and to which a generally U-shaped front support leg 22 and a generally U-shaped, pivotal rear support leg 23 are mounted. Each leg 22 and 23 includes a curved, centrally positioned mounting flange 24 extending towards the protective housing 12. Each mounting flange 24 includes a tang 25 positioned along its bottom edge. The pivot mounts 21 allow the rotational or pivotal movement of the protective housing 12 relative to the pivot mounts 21 and about horizontal axis AA, as indicated by arrow A. The fan 10 may also include an optional light 27 coupled to a pivot mount 21.

The base 11 also includes a ceiling mount portion 28 which is configured to be mounted to the ceiling C of a structure through the passage of mounting screws 29 extending through mounting screw holes 31 therein. The ceiling mount portion 28 includes a mounting plate 32, a rod 33 depending from the mounting plate 32, and a cup-shaped coupler 34 mounted to the bottom end of rod 33. The coupler 34 is configured to form an annular groove 35 therein adapted to receive the mounting flanges 24. The coupler 34 is also configured to allow the flanges 24 to be rotated while nested within the groove 35, thereby allowing rotational or pivotal movement of the fan housing about the rod 33 and about vertical axis AB, as indicated by arrow B. The coupler 34 also includes a series of detents 36 extending from the bottom of groove 35, which are configured to releasable receive mounting flange tangs 25. The mating of the tangs 25 within the detent 36 restricts rotational movement of the mounting flange 24 relative to the coupler 34, so that the fan does not rotate without being manually forced to do so, thereby preventing unwanted or accidental rotation during use.

Figure 2:
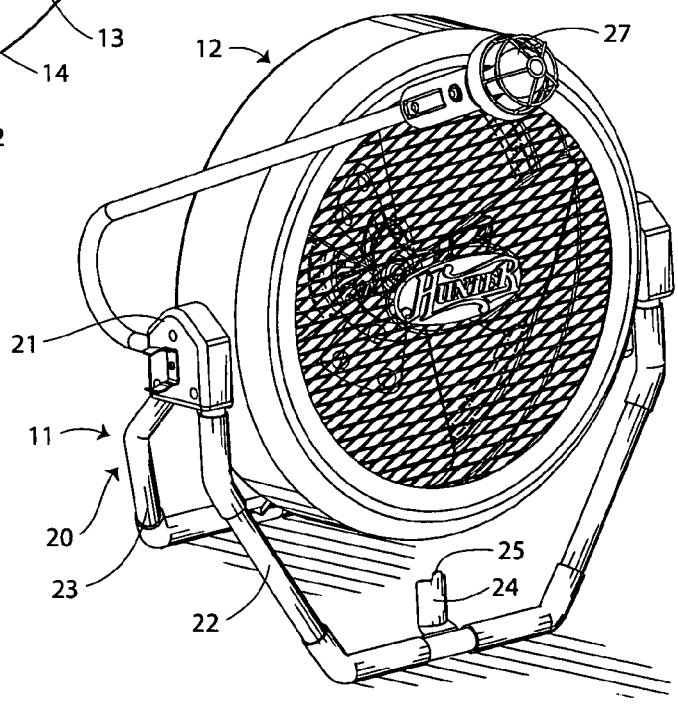
FIG. 2 is a perspective view of the fan mounting system of FIG. 1, shown in a dismounted position supported upon a floor.

In use, the fan 10 may be positioned upon an underlying surface, such as a floor, by simply pivoting the leg(s) 22 and 23 apart from each other so that the fan rests upon the bottom of the legs, as shown in FIG. 2. The fan may be transported and utilized in this unmounted position.

Figure 3:
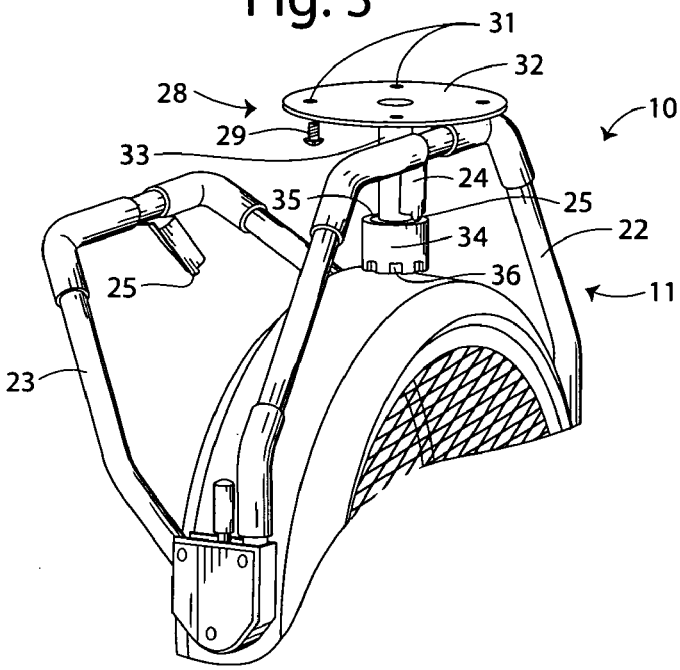
FIGS. 3 through 5 are a series of perspective views of the fan mounting system of FIG. 1 showing the mounting sequence.
Figure 4:
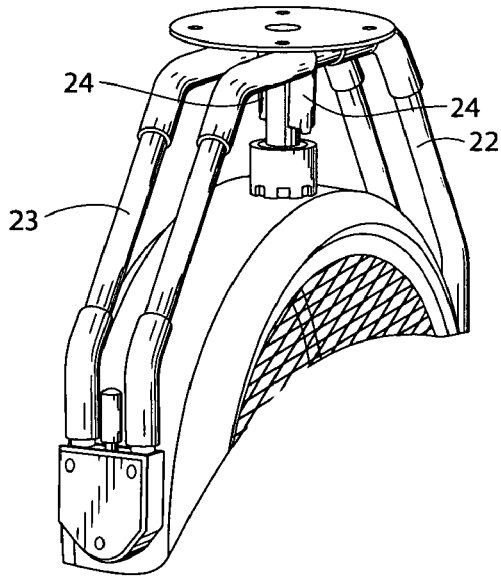
Figure 5:
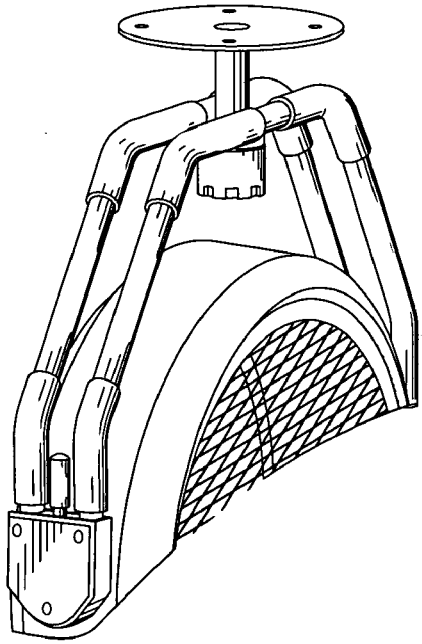

The fan may also be mounted to a ceiling C in an inverted or mounted position by bringing the legs 22 and 23 together and positioning their respective mounting flanges 24 above the coupler groove 35, as shown in FIGS. 3 and 4. The fan is then lowered so that the mounting flanges 24 are nested within the coupler groove 35, as shown in FIG. 5.

The airstream created by the fan may then be directed in the desired direction by rotating the legs 22 and 23 so that their flanges are rotated within the confines of the groove 35, as illustrated by arrow B. The positioning of the tangs 25 within the detents 36 initially resists rotational movement but is overcome with enough manual force or a slight manual lifting of the fan. Once the fan is rotated to its desired position the flange tangs are seated within the closest detent to prevent unwanted rotation. The fan housing may then be rotated in an upward or downward direction, as illustrated by arrow A, by manually pivoting it relative to pivot mounts 21.

It should be understood that the fan may be rotated in first direction along vertical axis AB and rotated in a second direction, generally normal to the first direction, along horizontal axis AA. This provides multi-directional movement of the fan towards any portion of a room.

It should be understood that as an alternative the mount portion may be designed to have one portion rotate relative to another portion. For example, the rod may be rotated relative to the mounting plate, the coupler may be rotated relative to the rod, or the rod may be made in two portions which are rotatable relative to each other.

It thus is seen that an improved fan mounting system is now provided which enables the fan to be mounted to a ceiling and rotated in two different directions to provide an airflow in virtually any direction. While this invention has been described in detail with particular references to the preferred embodiments thereof, it should be understood that many modifications, additions and deletions, in addition to those expressly recited, may be made thereto without departure from the spirit and scope of the invention as set forth in the following claims.

The invention claimed is:

1. A fan comprising, a motor;

an annular array of blades mounted to said motor;

a protective housing surrounding said annular array of blades;

a leg assembly configured to support said motor, said annular array of blades and said protective housing in use upon a horizontal support surface, said leg assembly having a pair of pivot mounts coupled to opposite sides of said protective housing and two legs pivotally coupled to said pivot mounts, said legs being capable of pivoting between a first position adjacent one another and a second position spread apart from one another, each said leg extending between said pair of pivot mounts and having a mounting flange; and a mount including a coupler adapted to be coupled to said mounting flanges and wherein said coupler has an annular groove adapted to receive said mounting flanges.

2. The fan of claim 1 wherein said annular groove includes detents and said mounting flanges are configured to cooperate with said detents.

3. The tan of claim 1 wherein said coupler allows pivotal rotation of said housing about a first axis of rotation.

4. The fan of claim 3 wherein said leg assembly is pivotally coupled to said protective housing to allow pivotal rotation of said housing about a second axis of rotation.

5. The fan of claim 4 wherein said first axis of rotation is oriented generally normal to said second axis of rotation.

6. A fan comprising, a motor;

an annular array of blades mounted to said motor;

a protective housing surrounding said annular array of blades;

a leg assembly pivotally coupled to said protective housing to enable said fan to be supported in use upon an underlying surface, said leg assembly adapted to provide rotation of said protective housing about a first axis of rotation;

a mount adapted to be pivotally coupled to said leg assembly for rotation of said protective housing about a second axis of rotation oriented generally normal to said first axis of rotation during use of the fan, wherein said mount includes a coupler and said leg assembly includes at least one leg having a mounting flange adapted to receive within said coupler to provide rotational movement about said second axis of rotation, wherein said coupler has an annular groove adapted to receive said mounting flange and wherein said annular groove includes detents and said mounting flange is configured to cooperate with said detents.

7. A fan comprising, a motor;

a blade assembly coupled to said motor;

a protective housing surrounding said blade assembly;

a supporting leg assembly having a pair of pivot mounts coupled to opposite sides of said protective housing and two legs pivotally coupled to said pivot mounts, said legs being capable of pivoting between a first position adjacent one another and a second position spread apart from one another, each said leg extending between said pair of pivot mounts and having a mounting flange, said leg assembly being coupled to said protective housing to allow pivotal motion of said protective housing about a generally horizontal axis of rotation; and a mount coupleable to said leg assembly to allow operative pivotal motion of said leg assembly and said housing about a generally vertical axis of rotation during use.

8. The fan of claim 7 wherein said mount includes a coupler and said leg mounting flanges adapted to receive within said coupler to provide rotational movement about said vertical axis of rotation.

9. The fan of claim 8 wherein said coupler has an annular groove adapted to receive said mounting flanges.

10. The fan of claim 9 wherein said annular groove includes detents and said mounting flanges are configured to cooperate wish said detents.

* * * * *